US005371435A

United States Patent [19]

Ohishi et al.

[11] Patent Number: 5,371,435

[45] Date of Patent: Dec. 6, 1994

[54] PHOTOELECTRON EMITTING DEVICE HAVING A PHOTOCATHODE MADE OF PHOTOELECTRIC MATERIAL

[75] Inventors: Keiichi Ohishi; Hideaki Suzuki; Hiroyuki Watanabe; Junichi Takeuchi, all of Hamamatsu, Japan

[73] Assignee: Hamamatsu Photonics K.K., Hamamatsu, Japan

[21] Appl. No.: 983,281

[22] Filed: Nov. 30, 1992

Related U.S. Application Data

[63] Continuation of Ser. No. 635,882, Jan. 4, 1991, abandoned.

[30] Foreign Application Priority Data

Jan. 8, 1990 [JP] Japan ..... 2-1270

[51] Int. Cl.[5] ..... H01J 43/04

[52] U.S. Cl. ..... 313/532; 313/103 CM; 313/105 CM; 313/535; 313/536; 313/542

[58] Field of Search ..... 313/103 R, 103 CM, 532, 313/533, 535, 536, 541, 542, 105 CM

[56] References Cited

U.S. PATENT DOCUMENTS 3,243,626 3/1966 Helvy et al. ..... 313/535

3,514,658 5/1970 Davis et al. ..... 313/103

FOREIGN PATENT DOCUMENTS 0386235 9/1990 European Pat. Off. .

49-37561 4/1974 Japan .

50-92079 7/1975 Japan .

OTHER PUBLICATIONS

Morrison, C. W., "Technique for Producing High-Sensitivity Rubidium-Cesium-Antimony Photocathodes", Journal of Applied Physics, Feb. 1966, vol. 37, No. 2, pp. 713-715.

Patent Abstracts of Japan, vol. 12, No. 277 (E-640)(3124) 30 Jul. 1988 & JP-A-63 058 751 (Hamamatsu Photonics K.K.) 14 Mar. 1988.

*Primary Examiner*—Donald J. Yusko

*Assistant Examiner*—Ashok Patel

*Attorney, Agent, or Firm*—Cushman, Darby & Cushman

[57] ABSTRACT

There is disclosed a process for forming a photocathode having high quantum yield which comprises the first step of making a number of fine concavities and convexities in a surface of a substrate finished substantially in a mirror; the second step of blunting the fine concavities and convexities; and the third step of coating a photoelectron emissive material on the surface of the substrate.

9 Claims, 8 Drawing Sheets

PHOTOELECTRON EMITTING DEVICE HAVING A PHOTOCATHODE MADE OF PHOTOELECTRIC MATERIAL

This is a continuation of application Ser. No. 07/635,882, filed on Jan. 4, 1991, now abandoned.

BACKGROUND OF THE INVENTION

1. Field of the Invention

This invention relates to a photoemitting device and a process for forming a photocathode, which is used in forming the photocathode of, e.g., semitransparent photomultipliers (PMT).

2. Related Background Art

It is known that the photocathode emits photoelectrons outside of a photoelectron emissive material in response to incident radiation. An important consideration with the formation of the photocathode is improvement of the so-called quantum yield. The photocathode is conventionally formed by applying Sb and an alkali metal, such as, K (potassium), Cs (caesium) or others, to a glass substrate finished as a mirror. The resultant photocathode has 25 to 27% in terms of quantum yield.

The level of the quantum yield directly affects the photosensitivity of a PMT with a photocathode. Due to this fact, conventionally there have been proposed some techniques for improving the photoelectron emission efficiency. To give examples, Y. Yajima et al. have proposed in Japanese Patent Laid-Open Publication (JPLO) 37561/1974 a photocathode having an electrically conductive substance coated selectively on the coating of an optical fiber plate. Y. Watase has proposed in (JPLO) 92079/1975 a technique for forming a stepped photocathode. Gordon Peter et al. have proposed in British Patent Application No. 6701/66 a technique for forming a number of prism elements on a glass plate to improve quantum yield. J. G. Edritz et al. have proposed in U.S. Pat. No. 406183 a technique for forming rectangular concavities and convexities in a glass plate to improve photoelectron emission efficiency. In addition to these techniques, various studies have been made without being able to attain a satisfactory level.

SUMMARY OF THE INVENTION

In achieving this invention, the inventors of the present application noticed the following points in terms of improving the quantum yield. That is, to improve the quantum yield, firstly it is necessary to increase a number of free electrons to be generated by incident radiation, and what is secondly necessary is to raise the rate of generated free electrons externally emitted. The inventors considered that for the first requirement the optical path of the incident radiation in a film (photocathode layer) of a photoelectron emissive material is made long, and for the second requirement the path of the free electrons through the photocathode layer is made short.

They discovered that the above requirements could be realized at the same time by forming the photocathode layer on a surface of the substrate which has a number of fine, blunt and unregular concavities and convexities.

A first object of this invention is to improve the quantum yield of the photocathode.

A second object of this invention is to provide a photomultiplier which can detect very weak light with high sensitivity.

A third object of the present invention is to provide a photoelectron emitting device comprising a substrate having a number of fine and blunt concavities and convexities formed in the surface; and a photocathode of a photoelectric converting material coated to the surface of the substrate.

A fourth object of the present invention is to provide a process for forming a photocathode comprising: the first step of making a number of fine concavities and convexities in a surface of a substrate finished substantially as a mirror; the second step of blunting the fine concavities and convexities; and the third step of coating a photoelectron emissive material on the surface of the substrate.

A fifth object of the present invention is to provide a photomultiplier tube comprising a vacuum container having the face plate of a light transmitting glass, and having the interior side of the face plate finished in a surface with fine and blunt concavities and convexities; a photocathode formed by depositing a photoelectric converting material on the interior side of the face plate; electron multiplying means for multiplying the photoelectrons emitted from the photocathode; and anode means for the multiplied electrons to be irradiated to.

By forming a photocathode by the above-described process, the optical path can be made long, while the path of the free electron can be made short, with the result of improvement of the quantum yield.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

One embodiment of this invention will be explained below with reference to the drawings attached hereto.

Figure 1A:
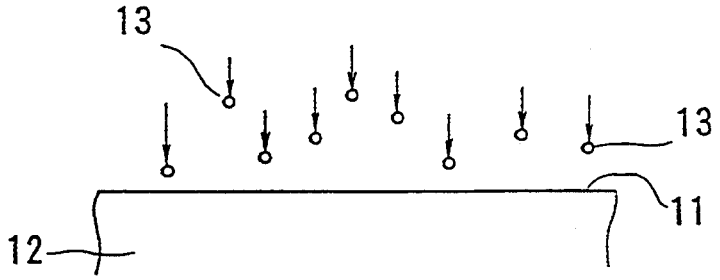
FIGS. 1A, 1B, 1C and 1D are respectively sectional views of the glass substrate for explaining the process for forming a photocathode according to one embodiment of this invention.
Figure 1B:
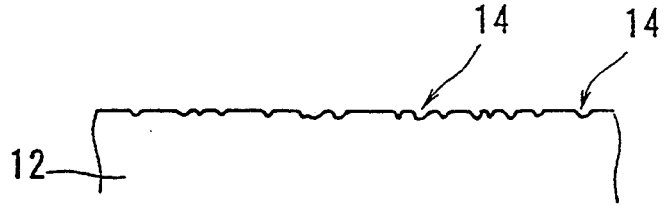

FIGS. 1A, 1B, 1C and 1D show the steps of the embodiment. First, as shown in FIG. 1A, a glass substrate 12 of. e.g., boro-silicate glass, having the surface 11 finished in a mirror is prepared, and a number of fine particles 13 are caused to impinge on the surface. As the fine particles 13, Carborundum or glass beads can be used. They are blown by, e.g., an air compressor onto the glass substrate 12 so as to be caused to collide against the surface 11 at high speed, so that fine flaws are made in the surface 11 of the glass substrate 12. As a result, a number of fine concavities and convexities are formed in the surface 11 (FIG. 1B).

Figure 1C:
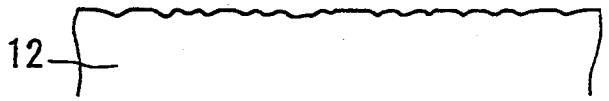
Figure 1D:
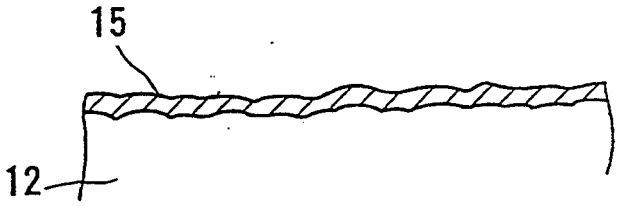

Next, the glass substrate 12 with the thus-formed flaws 14 is cleaned and dried. Then a treatment is performed so as to blunt the concavities and convexities in the surface, and as shown in FIG. 1C, the concavities and convexities in the surface 11 are made less noticeable. The treatment of blunting the concavities and convexities may comprise etching the glass substrate with a chemical, e.g., hydrogen fluoride, which is corrosive to glass, or by heating the surface 11 by a burner, electric furnace or the like to soften the same, and blunting the concavities and convexities. Then, a film 15 of a photoelectric converting material is applied to the surface 11 of the glass substrate 12 (FIG. 1D).

Figure 2A:
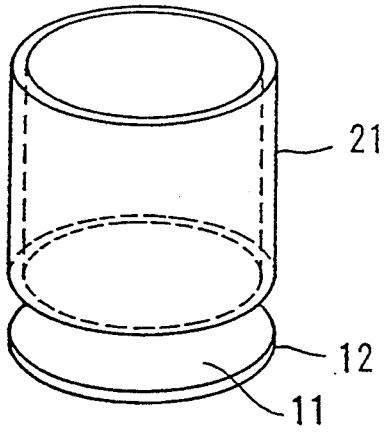
FIGS. 2A, 2B, 2C, 2D and 2E are views explaining the formation of the photocathode of a semitransparent PMT.
Figure 2B:
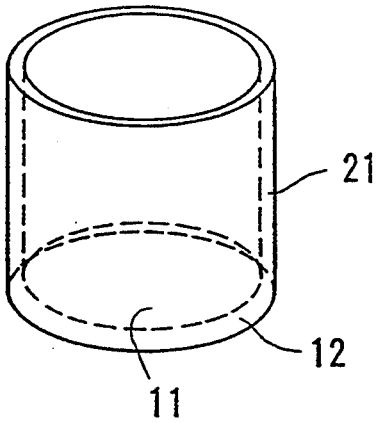
Figure 2C:
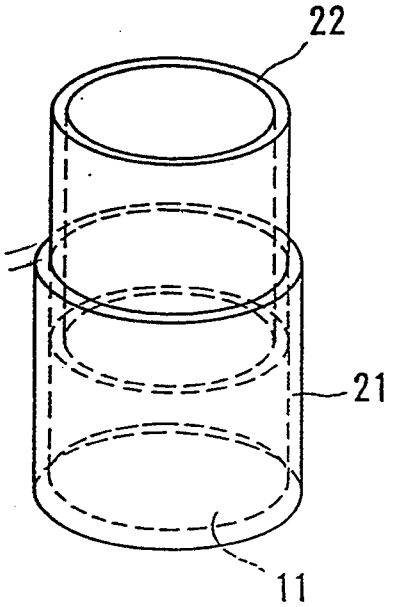

Next, with reference to FIGS. 2A, 2B and 2C one example of the application of the process according to this embodiment to the formation of the photocathode of a semi-transparent photomultiplier is described.

Figure 2D:
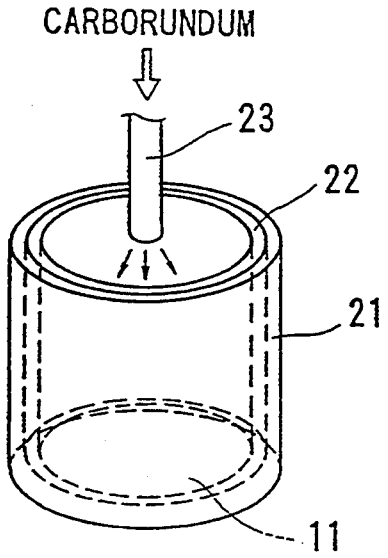

First, as shown in FIG. 2A, a glass pipe 21 for the PMT, and a glass substrate 12 for the face plate are prepared. The glass pipe 21 and the glass substrate 12 are integrated so that the surface 11 of the glass substrate 12 becomes the interior face of the face plate of the PMT (FIG. 2B). Next, a tubular jig 22 having an outer diameter a little smaller than the inner diameter of the glass pipe 21 is prepared, and as shown in FIG. 2C, the former is put in the latter, and the interior side of the glass pipe 21 is protected by the jig 22 with only the surface 11 (the interior face of the face plate) of the glass substrate 12 exposed. Then a nozzle 23 is inserted in the pipe 21, directed to the surface 11 of the glass substrate 12 to blow particles, such as Carborundum or others which can be carried in compressed air. Fine flaws are made in the surface 11 of the glass substrate 12 (FIG. 2D). For Carborundum #400 (Japanese Industrial Standard), the air pressure is about 4 kg/cm$^2$, and for glass beads, the air pressure is about 5 kg/cm$^2$.

Figure 2E:
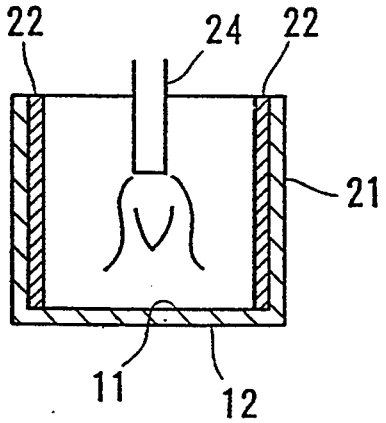

Then, as shown in FIG. 2E, a burner 24 is inserted to heat the surface 11 of the glass substrate 12 with mixed flame of propane and oxygen, or butane gas and oxygen and reduce the fine flaws to blunt concavities and convexities. To blunt the fine flaws with chemical treatment, hydrogen fluoride (HF), ammonium fluoride (NH4F), alkali (NaOH, KOH), or others can be used. In order to form the photocathode without attaching the glass pipe 21 to the glass substrate 12, the glass substrate 12 can be heated in a furnace at 900° C. for 2 to 3 hours to blunt the fine flaws in the surface 11. In this case the jig 22 is not necessary.

When the above-described treatment is over, the entire bulb is cleaned and dried. Then, after the pipe 21 is heated in a furnace at about 500° C., aluminum (Al) is vaporized on the pipe 21, and the pipe 21 and the stem with electrodes which are necessary for deposition of photocathode material and anode are sealed to each other. Then the pipe 21 is evacuated, and the surface 11 of the glass substrate 12 having the blunt concavities and convexities provides a photocathode. Those of ordinary skill in the art will readily appreciate that since the particles are blown across the surface of substrate 12, the locations of the concavities and convexities are not planned. Therefore, the concavities and convexities are randomly placed. This is illustrated in FIG. 1.

Figure 3A:
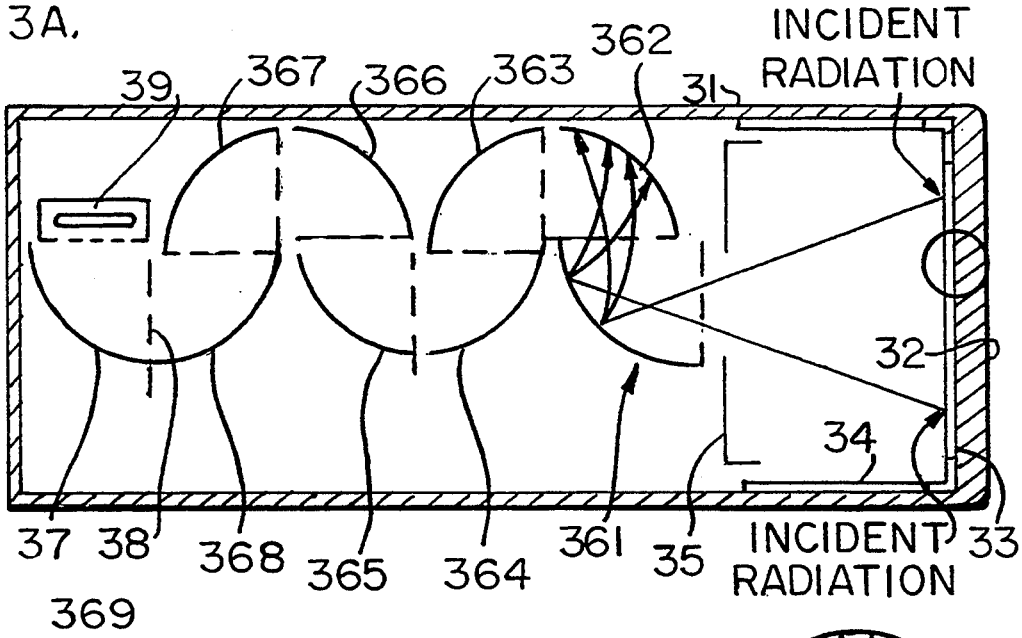
FIG. 3A is a view of a PMT of box-and-grid type.
Figure 3B:
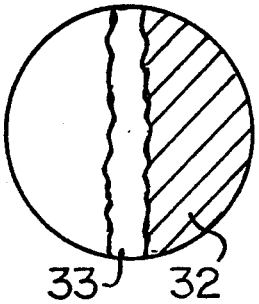
FIG. 3B is an enlargement of the encircled area of FIG. 3A.

The PTM, the photocathode according to this invention, will be explained below. FIG. 3A shows a box-and-grid multiplier structure. This PTM uses nine dynodes as the electron multiplier. The dynodes are constituted by boxes and accelerating grids. As shown in FIG. 3A, the semi-transparent photocathode 33 is formed in the interior side of a face plate 32 secured to a cylindrical vacuum container 31. An internal conductive coating 34 is applied to the interior wall of the container 31 near the photocathode 33 and electrically contacted with the photocathode 33. Within the container 31, there is provided a focusing electrode 35. The nine dynodes 361 to 369 are disposed behind the electrode 35. The dynodes are constituted by boxes 37 and grids 38. Behind the dynode 369 there is provided an anode 39. In the PMT according to this invention, the interior side of the face plate 32 is finished as a surface with blunt concavities and convexities. On this interior side a photocathode of, e.g., bi-alkali, is formed. Here bi-alkali means alloys, mixed crystals or polycrystals of two or more kinds of alkali metals, such as sodium (Na), potassium (K), caesium (Cs) or others.

Figure 4A:
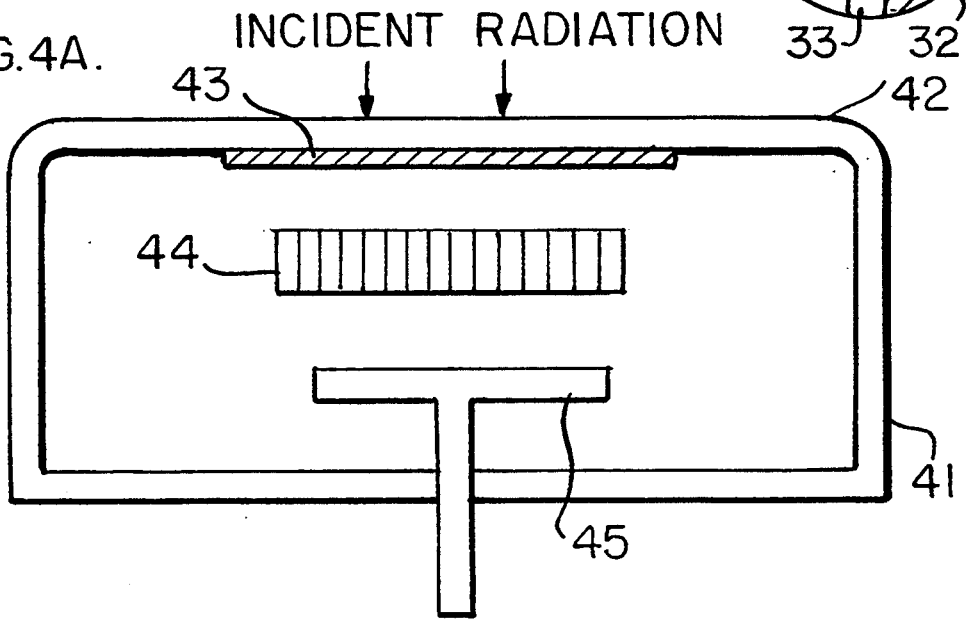
FIG. 4A is a view of a PMT with a microchannel plate.
Figure 4B:
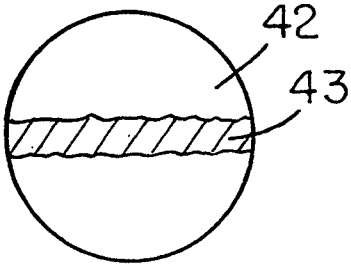
FIG. 4B is an enlargement of the encircled area of FIG. 4A.

FIG. 4A shows a PMT with a microchannel plate (MCP). In this PMT, the interior side of the glass face plate 42 of a vacuum container 41 is finished as a surface with blunt concavities and convexities as shown in FIG. 4A. On this surface the photocathode 43 is formed. Within the container 41 there is provided an MCP 44 for multiplying the photoelectrons emitted by the photocathode 43, and an anode 45 is provided behind the MCP 44. According to this invention, the photocathode can emit photoelectrons with high efficiency, which makes it possible to provide a PMT having high photosensitivity.

Figure 7:
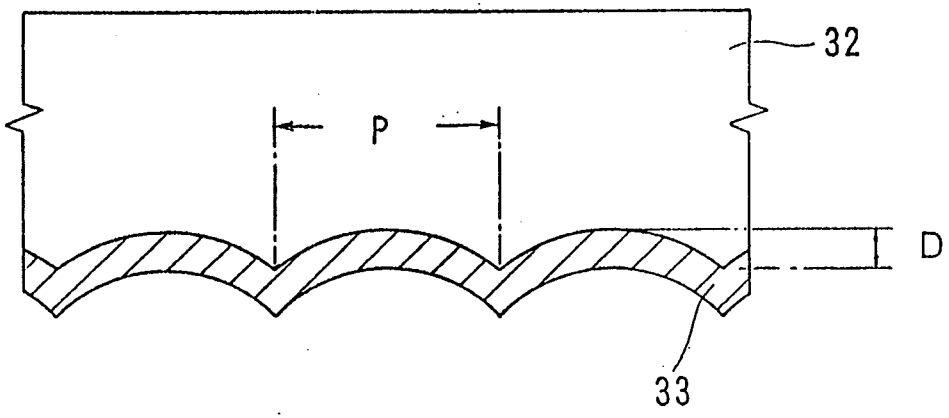
FIG. 7 is an enlarged and explanatory cross sectional view of the surface of the face plate.
Figure 8:
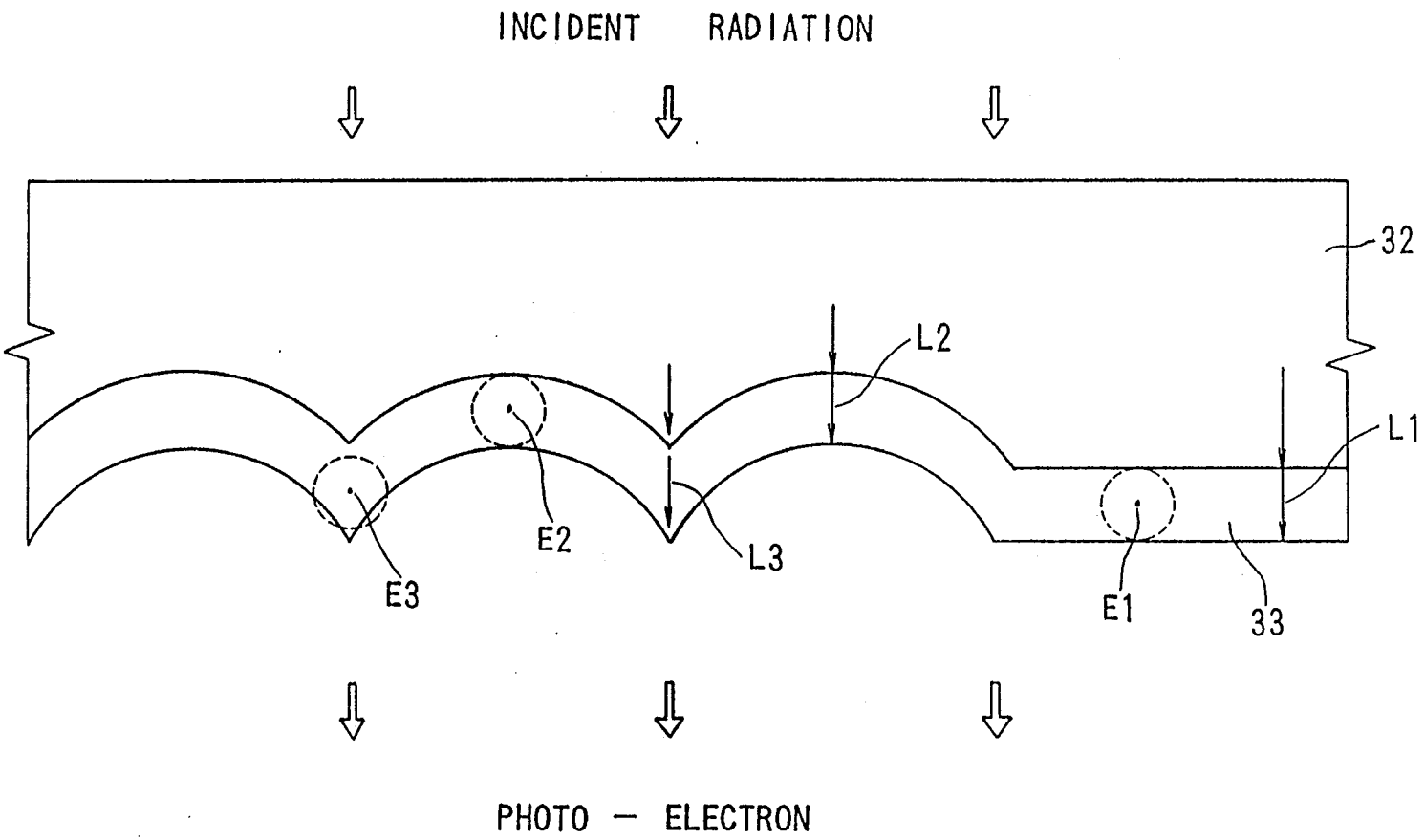
FIG. 8 is a drawing for explaining the principle of the present invention.

Hereinafter the terminology of "the fine and blunt concavities and convexities" will be explained in reference with FIG. 7 and 8. FIG. 7 shows an enlarged and explanatory cross sectional view of faceplate 32 on which photocathode 33 is formed. The interval P denoted in FIG. 7 between adjacent concavities or adjacent convexities is 10 to 20 μm the depth D is 3 to 7 μm, preferably around 5 μm. FIG. 8 shows a principle that the path of incident light becomes satistically longer and that of free electrons become statistically shorter in the photocathode 33 according to the invention. It is easily understood that the path of incident light becomes longer according to the invention with following equation where the path of incident light in the photocathode 33 for area of flat surface is indicated as L1, that for concavities portion of the fine concavities and convexities area is indicated as L2, and that for convexities portion of the fine concavities and convexities area is indicated as L3.

$$L1 \approx L2 < L3$$

On the other hand, it is understood that the path of photoelectrons for the convexities portion of the fine concavities and convexities has become shorter provided that the positions where photo-electrons are generated are the center positions of the photocathode 33, that is, points E1, E2 and E3 in FIG. 8 In FIG. 8, all radii of dotted circles with centers at points E1, E2 and E3 are same. It is understood that a photoelectron generated at point E3 can be ejected outside of photocathode 33, that is, inside of PMT in shorter time.

Next, the tests made by the inventors will be elaborated below.

Figure 5A:
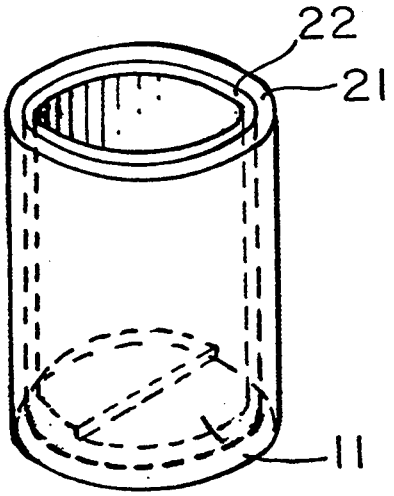
FIGS. 5A, 5B and 5C are views explaining the jig used in Example 1.
Figure 5B:
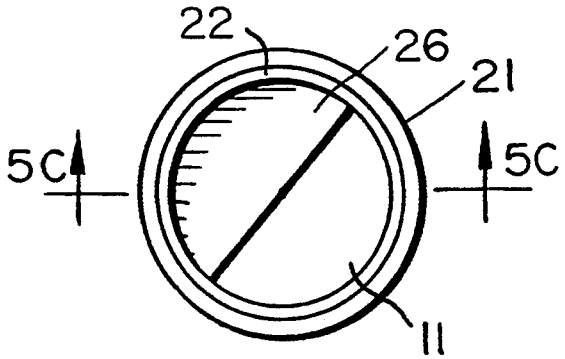
Figure 5C:
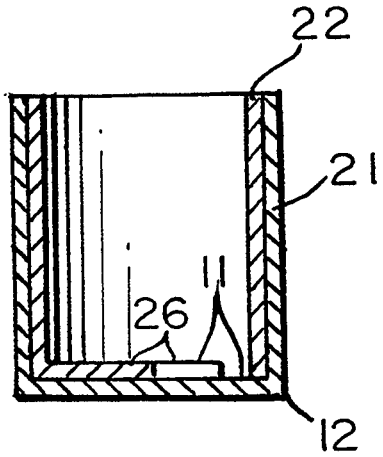

The jig 22 of FIG. 5 was used for the tests. The jig was formed so as to be accommodated in a body constituted by the glass substrate 12 and the glass pipe 21 with a half of the bottom of the jig 22 closed by a bottom plate 26. By using the tubular jig with such bottom plate 26, the treatment with Carborundum, hydrogen fluoride or others was limited to a half of the surface 11 of the glass substrate 12, which facilitated accurate comparison of this invention with the conventional art.

EXAMPLE 1

Only a half of the surface 11 of the glass substrate 12 was flawed with Carborundum, then the jig was removed, and the entire surface 11 of the glass substrate 12 was etched with hydrogen fluoride. The etching periods of time were 10 seconds, 20 seconds and 30 seconds. The body was cleaned and dried, and then a bi-alkali photocathode was formed to measure the quantum yield. The measured result is as follows. For the etching with only hydrogen fluoride, the quantum yield at a 420 nm-wavelength was

| | | |
|---|---|---|
| Etching time | 10 seconds | 27.3% |
| | 20 seconds | 27.6% |
| | 30 seconds | 27.9%. |

For the etching with Carborundum, the quantum yield at a 420 nm-wavelength was

| | | |
|---|---|---|
| Etching time | 10 seconds | 29.3% |
| | 20 seconds | 31.8% |
| | 30 seconds | 30.6%. |

The process of this invention has improved the quantum yield by about 4%. Electron microscopic and optical microscopic observation of the surface showed that the surface etched longer with Carborundum has blunter concavities and convexities.

EXAMPLE 2

Six sheets of glass substrate 12 were prepared. A photoelectric surface was formed on one of the six sheets without any treatment. This sheet is Sample A. Carborundum was blown onto the remaining five sheets to flaw them. A photocathode was formed on one of the five sheets without blunting the flaws. This is Sample B.

One of the remaining four sheets was etched with ammonium fluoride of a 20% concentration for 45 minutes (at the room temperature) and cleaned, and a photocathode was formed thereon. This sheet was Sample C. One of the remaining sheets was etched with ammonium fluoride of a 10% concentration for 90 minutes (at the room temperature) and cleaned, and a photocathode was formed thereon. This sheet was Sample D. One of the remaining sheets was exposed to a flame of 700° to 900° C. for 3 to 5 minutes and cooled, and a photocathode was formed thereon. This sheet was Sample E.

The last one sheet was etched with hydrogen fluoride of a 50% concentration for 15 minutes (at the room temperature), and cleaned and dried, and a photocathode was formed thereon This sheet was Sample F.

Figure 6:
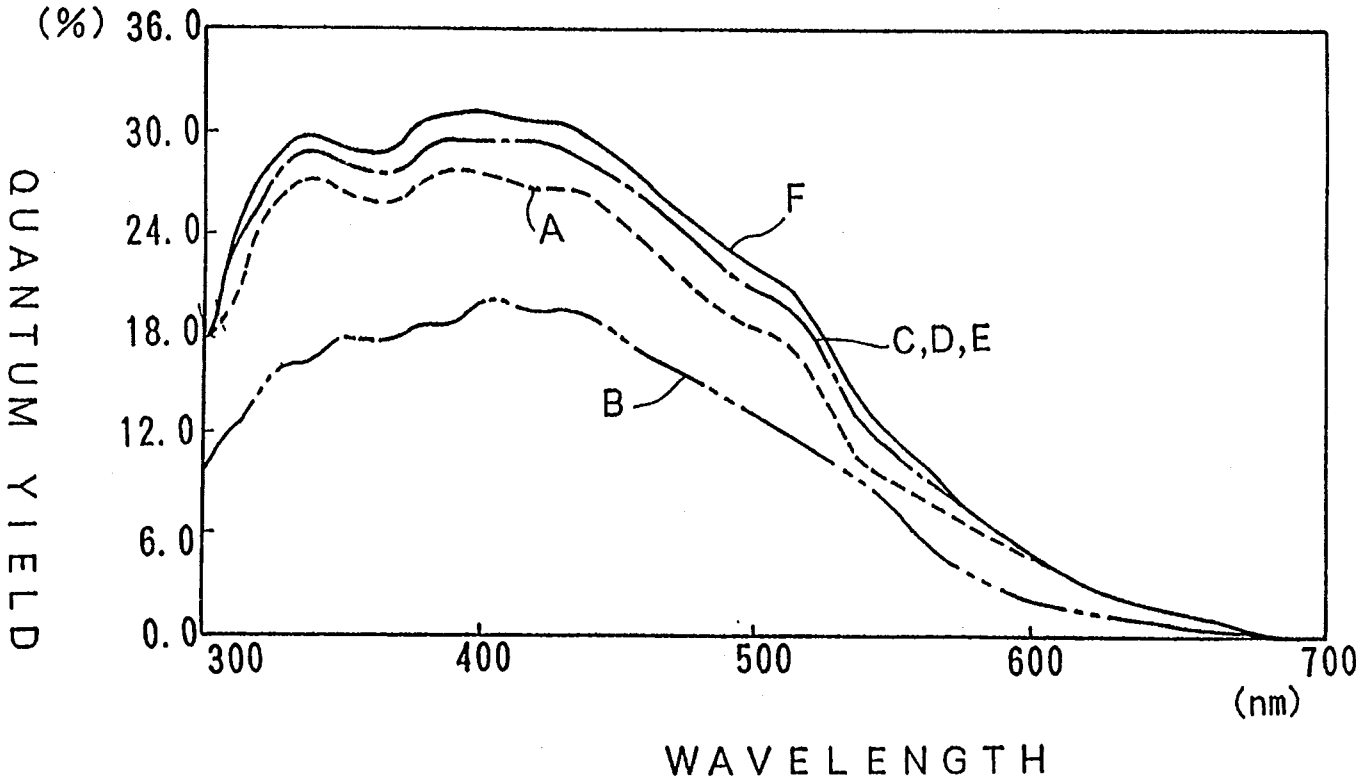
FIG. 6 is a graph showing the result of Example 2.

The quantum yields of Samples A to F are shown in FIG. 6. It is shown that only the treatment of Carborundum lowers the quantum yield, but the treatment of blunting the concavities and convexities following the Carborundum treatment improves the quantum yields in all the Samples. For PMTs, etc., whose detection object is very fine and faint radiation, the improvement of the quantum yield by 2% to 4% contributes greatly to the improvement of the photosensitivity of the entire devices.

As described above, according to this invention, fine flaws are made in the surface of a glass substrate, then the flaws are blunted by the chemical treatment or the heat treatment, and a photocathode is formed on the surface. Consequently the optical path of incident radiation is made longer, while the path of free electrons can be made short, with the result that the quantum yield can be improved.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A photoelectron emitting device comprising:

a substrate having a number of concavities and convexities on one major surface thereof, the concavities and convexities being randomly placed and constituted by curved surfaces; and a photocathode made of a photoelectric converting material, the photocathode being deposited on the major surface of the substrate having the concavities and convexities.

2. A photoelectron emitting device according to claim 1, where the substrate is made of a light transmitting material.

3. A photoelectron emitting device according to claim 1, wherein the concavities and convexities on the major surface of the substrate are formed by applying a physical impact to the major surface of the substrate and thereafter utilizing chemical etching, or heating to soften the major surface of the substrate.

4. A photoelectron emitting device according to claim 1, wherein the convexities are about 3 to 7 micrometers deep and adjacent convexities or adjacent concavities are about 10 to 20 micrometers apart.

5. A photoelectron emitting device according to claim 1, wherein the concavities and convexities are formed by blowing fine particles against the major surface.

6. A photomultipler tube comprising:

a vacuum container having a face plate of a light transmitting glass, the face plate having an interior side with a number of concavities and convexities on a major surface thereof, the concavities and convexities being randomly placed and constituted by curved surfaces;

a photocathode made of a photoelectric converting material, the photocathode being deposited on the interior side of the face plate;

electron multiplying means for multiplying photoelectrons emitted from the photocathode; and anode means for collecting multiplied photoelectrons.

7. A photomultiplier tube according to claim 6, wherein the photoelectric converting material of the photocathode contains at least one kind of alkali metal.

8. A photomultiplier tube according to claim 6, wherein the convexities are about 3 to 7 micrometers deep and adjacent convexities or adjacent concavities are about 10 to 20 micrometers apart.

9. A photomultiplier tube according to claim 6, wherein the concavities and convexities are formed by blowing fine particles against the major surface.

* * * * *